United States Patent [19]

Smith

[11] Patent Number: 4,982,544

[45] Date of Patent: Jan. 8, 1991

[54] MODULE AND METHOD FOR CONSTRUCTING SEALING LOAD-BEARING RETAINING WALL

[75] Inventor: Peter J. Smith, Gansevoort, N.Y.

[73] Assignee: Pomico International, Inc., New York, N.Y.

[21] Appl. No.: 282,519

[22] Filed: Dec. 12, 1988

[51] Int. Cl.[5] ..... E04C 2/04

[52] U.S. Cl. ..... 52/606; 52/593; 52/603

[58] Field of Search ..... 52/603, 604, 606, 607, 52/593, 612; 405/273, 274, 279, 284, 285, 286

[56] References Cited

U.S. PATENT DOCUMENTS

| | | | |
|---|---|---|---|
| 2,042,992 | 6/1936 | Hine et al. | 52/593 |
| 4,372,091 | 2/1983 | Brown et al. | 52/593 |

FOREIGN PATENT DOCUMENTS

| | | | |
|---|---|---|---|
| 2714341 | 9/1978 | Fed. Rep. of Germany | 52/606 |
| 993497 | 1/1951 | France | 52/606 |
| 1074491 | 4/1959 | France | 52/606 |

*Primary Examiner*—David A. Scherbel
*Assistant Examiner*—Creighton Smith
*Attorney, Agent, or Firm*—Kenyon & Kenyon

[57] ABSTRACT

A monolithic sealing load-bearing retaining wall is constructed using precast concrete bin-type modules stacked in rows. Each module has a front wall, a partition wall spaced from the front wall, at least two spaced apart front connecting walls extending between the front wall and the partition wall, at least two spaced apart rear connecting walls extending from the rear of the partition wall, and stabilizing means extending between the rear connecting walls. The partition wall preferably is formed integrally with the front connecting walls, which provide openings for horizontally extending reinforcing members in each row of modules. The front walls and partition walls of the stacked modules serve as forms for concrete poured in the spaces between them. Upon curing, the poured concrete integrates with the front walls, partition walls, associated portions of the front connecting walls, and the reinforcing members to create a monolithic sealing load-bearing wall capable of supporting bridge girders and the like and of preventing water leakage through the wall in either direction. The stabilizing means can be metal sheets or high-strength polymer webs inserted through slots in the rear connecting walls.

8 Claims, 5 Drawing Sheets

MODULE AND METHOD FOR CONSTRUCTING SEALING LOAD-BEARING RETAINING WALL

BACKGROUND OF THE INVENTION

1. Technical Field

The present invention relates to precast concrete structural units for use in the construction of retaining walls and particularly to such structural units for use in the construction of sealing load-bearing retaining walls.

2. Background Art

Load bearing retaining walls such as roadway bridge abutments traditionally are constructed of concrete poured at the site. This type of construction is slow and labor intensive, involving setting up and stripping forms.

To save time and expense, systems of precast concrete modules have been developed for use in erecting retaining walls in general, and some of these modular systems have been proposed for bridge abutments. One such modular system is disclosed in U.S. Pat. No. 4,372,091 of BROWN et al. The precast modules of BROWN et al. are bin-type structures having a pair of spaced longitudinally extending side panels and a pair of laterally extending connecting arms that combine to form a rectangular bin open at both top and bottom. The side panels are rectangular and serve as the front and back faces of a retaining wall when the modules are stacked in rows like bricks or building blocks. The upper and lower edges of the connecting arms are formed with mortise and tenon lateral interlocking means that increase the structural integrity of the assembled retaining wall.

The connecting arms of the BROWN et al. modules are spaced from the ends of the side panels by one-quarter of the length of the panels, so that when the modules are placed end-to-end in a row, bins are formed between each module that are equal in size to the bins formed between the pair of connecting arms of the module. The modules of the next superposed row can be stacked either in vertical alignment with corresponding subjacent modules or staggered half-and-half on two adjoining subjacent modules. Either way, this results in interior columnar openings which are continuous vertically and which are adapted for the receipt of fill material. The fill material adds weight to the modules to offset forces applied by additional fill to the rear of the wall. The assembled modular wall thus acts as a "gravity wall."

The thickness of both side panels and the connecting arms of the BROWN et al. modules increases from top to bottom, both to provide draft for ease in removing from the mold and to provide inclined side surfaces so that a major part of the weight of the fill is effectively transferred to become part of the weight of the modules.

The precast bin-type modules of BROWN et al. are effective in constructing a retaining wall which is subjected primarily to lateral forces by the fill behind the wall. The patent also suggests that the modules can be used to construct a bridge abutment, which must carry substantial vertical loads as well as resist lateral horizontal forces. The design of the module is not well adapted to this function, however, because the columns of fill inside the bins will tend to settle over time, even if compacted. Consequently, the vertical live and dead loads of the bridge must be carried essentially entirely by the precast concrete module structure. To distribute these loads uniformly to both side panels and both connecting arms of each module in the top row, BROWN et al. provide a concrete pad that overlies the entire module. The ends of the bridge girders rest on a bearing member that is located back from the face of the abutment by a distance at least half the width of the upper row of modules to properly distribute the load through the composite wall of modules down to a footing. This arrangement can increase the distance between supports of the bridge girders by several feet and correspondingly increase the weight and cost of the bridge materials. In addition, the ultimate vertical load-bearing capability of the modules is limited by the thickness of the side panels and connecting arms. For economy, however, this thickness should be no greater than is necessary for the normal usage of the modules in a retaining wall having no substantial vertical loading.

U.S. Pat. Nos. 3,981,038 and 4,564,967 of VIDAL disclose a bridge abutment construction system that uses precast concrete wall panels that are retained by elongated steel strip reinforcing members attached to the rear of each panel and extending into a stabilized earth mass. This is not a gravity wall system; the wall panels resist horizontal loading forces through offsetting frictional forces between the stabilized earth mass and the steel strip reinforcing members. In U.S. Pat. No. 3,981,038, the stabilized earth mass behind the wall supports the vertical load exerted by the ends of the bridge girders. In U.S. Pat. No. 4,564,967, VIDAL presents an improvement in which the vertical load of the deck of the bridge is supported independently of the earth mass, which absorbs any horizontal forces. The vertical support means comprises a plurality of vertical concrete pillars or columns connected to the rear faces of the panels. The forms for the columns comprise pipe sections either formed integrally with the panels or attached to the rear faces of the panels. The abutment is built up of successive rows of panels, with reinforcing strips for each row of panels laid out on successive layers of compacted earth. The panels are vertically aligned so that the pipe sections cooperate to form a vertical form extending from a footing to the top of the wall. Concrete is then poured into the vertical pipe forms, and a beam seat is mounted on the pillars.

These support columns of VIDAL '967 are relatively thin and require the support of the stabilized earth around each column and attachment to the face panels to prevent buckling.

Since the panels must be vertically aligned in order to align the pipe sections, the resulting wall has a series of vertical joints, making it inherently less stable than a wall having staggered rows of panels. In addition, because of the large volume of stabilized earth required behind the abutment wall, the VIDAL system is suitable primarily for bridges having filled approaches. Even in such applications, the attachment and careful placement of the elongated reinforcing members between layers of stabilized earth is labor intensive and time consuming compared with the rapid setup of the bin-type modules of BROWN et al.

A further disadvantage of prior retaining walls and bridge abutments of the modular type is that moisture in the fill behind the wall will seep through the joints between the face panels of the modules. This is unsightly and eventually can lead to erosion and corrosion of the concrete facing.

SUMMARY OF THE INVENTION

The present invention solves the problem of providing a sealing load-bearing retaining wall such as a bridge abutment assembled from bin-type precast concrete modules but having the strength, integrity, and vertical load capacity of a traditional cast-in-place monolithic concrete abutment. The invention includes a precast concrete module, a method of constructing a sealing load-bearing retaining wall using the modules, and the retaining wall produced by the method.

The precast concrete module comprises:

a front wall having a front face, a rear face, a top, a bottom, and two ends;

a partition wall spaced from the rear face of the front wall, the partition wall having a front face, a rear face, a top, a bottom, and two ends;

first and second spaced apart front connecting walls extending from the rear face of the front wall to the front face of the partition wall;

first and second spaced apart rear connecting walls connected to and extending from the rear face of the partition wall; and stabilizing means spaced from the rear face of the partition wall and extending between the first and second rear connecting walls, wherein the area of each front connecting wall is less than the total area defined between the partition wall and the front wall and between the top and bottom of the front wall such that when at least two modules are arranged in at least one horizontal row, a clear space is provided for horizontal reinforcing bars extending the length of each horizontal row of modules between the front wall and the partition wall.

The stabilizing means may comprise a rear wall that is parallel to the front wall and is formed integrally with, and at the rear ends of, the rear connecting walls. Alternatively, the stabilizing means may be a sheet of material stretched between the rear connecting walls.

The method of constructing a sealing load-bearing retaining wall composed of modules having a front wall, first and second connecting walls, and stabilizing means extending between the connecting walls comprises:

(a) providing a concrete footing for the retaining wall;

(b) placing a first horizontal row of the modules on the footing, the front walls of the modules being aligned to form an exposed face of the abutment;

(c) providing each module in the first row with a partition wall between the front wall and the stabilizing means and spaced a predetermined distance from the front wall, the partition walls of adjacent modules abutting each other;

(d) setting at least one additional row of modules on said first row to obtain a predetermined height for the retaining wall;

(e) repeating step (c) for the modules in each additional row; and (f) pouring concrete into the spaces between the front walls and the partition walls of the assembled modules to create a monolithic concrete sealing load-bearing retaining wall.

The retaining wall produced by the method of the invention comprises:

a plurality of superposed rows of precast concrete modules, each module having a front wall, a partition wall spaced from the front wall, first and second spaced apart front connecting walls extending between the front wall and the partition wall, first and second spaced apart rear connecting walls extending rearwardly from the partition wall, and stabilizing means extending between the first and second rear connecting walls;

vertical reinforcing members extending from the bottom to the top of the rows of modules in the region between the front walls and the partition walls;

horizontal reinforcing members extending the length of at least one row of modules in the region between the front walls and the partition walls of the modules in the row; and poured concrete filling the region between the front walls and the partition walls of the modules to create, in combination with the front walls, partition walls, the front connecting walls therebetween and the vertical and horizontal reinforcing members, a monolithic load-bearing wall for the abutment that also ties all the modules together and seals against leaks through the interfaces between the front walls of contiguous modules.

Additional features and advantages of the invention are disclosed in the following description of selected illustrated embodiments which, although representing the currently preferred arrangements, are not intended to limit the scope of the invention as disclosed and claimed.

BRIEF DESCRIPTION OF THE DRAWINGS

In the accompanying figures, the identical elements are designated by a single reference numeral. Where one or more elements are similar but not identical, they are designated by the same reference numeral followed by different lower case letters. Similar elements may be referred to collectively in the description by their common reference, numeral alone.

DETAILED DESCRIPTION OF THE PREFERRED EMBODIMENTS

Figure 1:
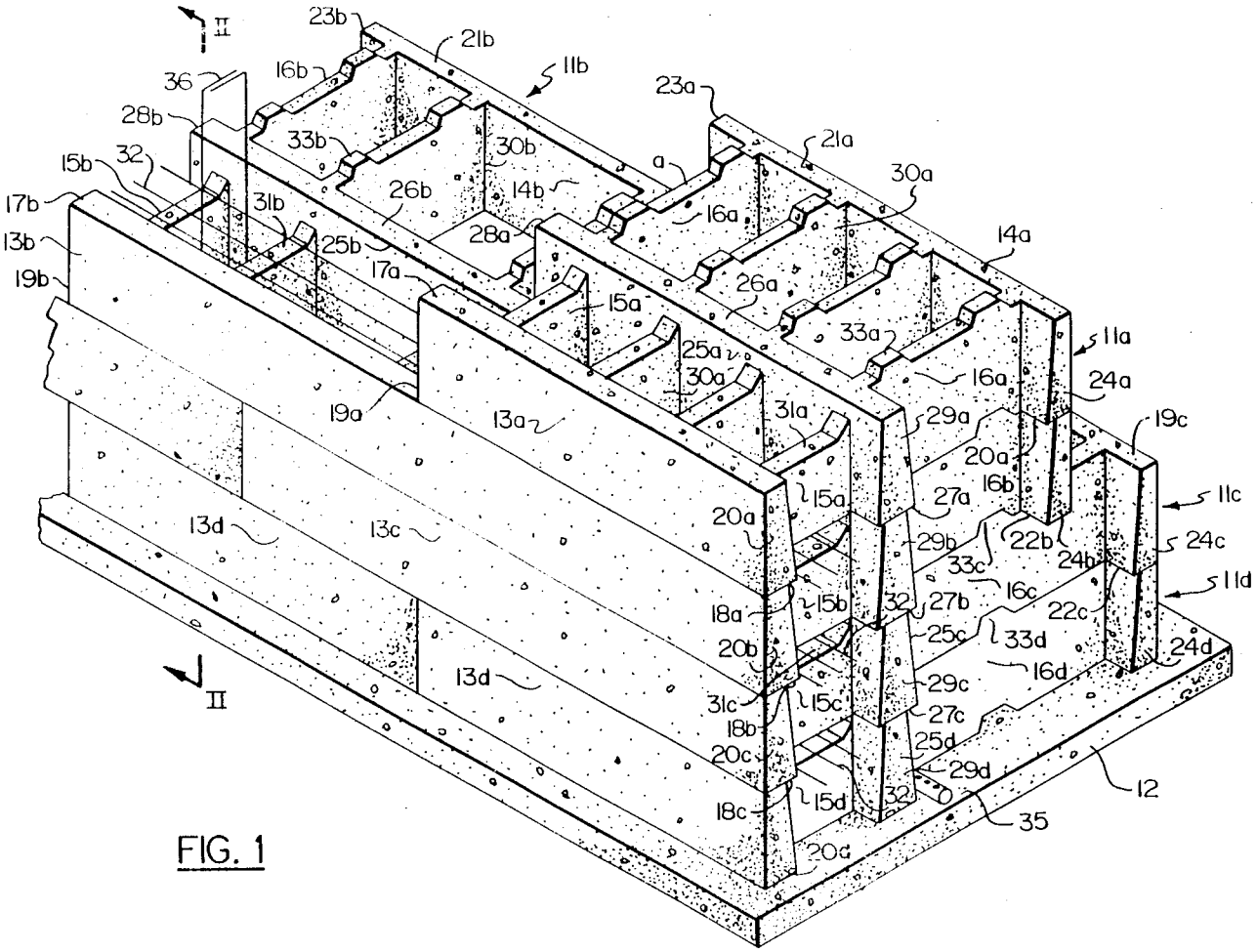
FIG. 1 is a perspective view of a stacked assembly of precast concrete modules.

With reference to FIG. 1, a plurality of similar precast concrete modules 11*a*, 11*b*, 11*c*, and 11*d* are stacked in staggered rows on a footing slab 12 to form a retaining wall, as for a bridge abutment. Each module 11 is formed as an open bin, preferably rectangular, having a front wall 13, a stabilizing means such as rear wall 14, and spaced apart front and rear connecting walls 15, 16 extending between the front and rear walls. Each front wall has a top 17, a bottom 18 and two ends 19, 20. Each rear wall has a top 21, a bottom 22, and two ends 23, 24.

The front and rear connecting walls 15, 16 preferably join the front and rear walls at locations spaced inwardly from the two ends of the front wall and of the rear wall. The inward spacing of the connecting walls from the respective ends of the front wall and the partition wall is preferably one-half the spacing between adjacent connecting walls. This creates a space between adjacent connecting walls of two modules, when the ends of the front and rear walls of the modules abut each other, that is the same size as the corresponding internal spaces in each module. Also preferably the thickness of the front, rear, and connecting walls increases from top to bottom of each module. This provides draft to facilitate stripping the module from the mold.

As is apparent from FIG. 1, the front-to-rear dimensions of the lower row or rows of modules 11*c*, 11*d* in a multi-row stack may be greater than the front-to-rear dimensions of the modules 11*a*, 11*b* in upper rows, to meet stability requirements depending on the total height of the retaining wall or bridge abutment. In addition, the length dimensions of the modules 11*a*, 11*b*, 11*c* may differ, as shown, to provide staggered joints in successive rows starting from one end of the retaining wall.

Many of the above-described elements and features are known, for example, from the previously discussed U.S. Pat. No. 4,372,091 of BROWN et al. The modules of the present invention have the following additional features, however, that are particularly intended and adapted to solve the problem of creating a monolithic abutment supporting wall by use of modules that can be easily and rapidly installed with only a few nonskilled workers.

Specifically, each module includes a longitudinal partition wall 25, preferably formed integrally with at least the front connecting walls and disposed between the front and rear walls at a preselected distance from the front wall. Each partition wall has a top 26, a bottom 27, a first end 28, and a second end 29. The first end 28 of the partition wall lies in a plane containing the ends 19 and 23 of the front and rear walls, and the second end 29 of the partition wall lies in a plane containing the other ends 20 and 24 of the front and rear walls, respectively. Preferably, the length dimensions of the front, partition, and rear walls are all equal, and the same is true for the height dimensions of these walls. This allows adjacent ends of the front, partition, and rear walls of adjacent modules to abut each other when the modules are aligned in horizontal rows and for tops of these walls in one row to abut the bottoms of the corresponding walls in the next row above.

Each module may have further intermediate connecting walls 30 in addition to and spaced between the front and rear connecting walls 15, 16. The intermediate connecting walls preferably are spaced equally from the front and rear connecting walls and from each other, the spacing distance being equal to twice the distance that the front and rear connecting walls are spaced from the ends of the front, partition, and rear walls. Module 11*a* in FIG. 1 illustrates such an equal spacing.

The purpose of the intermediate connecting walls 30 is to provide additional strength and rigidity to the modules, so as to withstand stresses imposed both during handling and transport and during the process of creating a monolithic retaining wall at a construction site. Under some conditions, it may be possible to eliminate one or more intermediate walls, as shown by module 11*b* in FIG. 1. Also, in appropriate circumstances, some or all of the intermediate walls may extend only between the front wall and the partition wall, or only between the partition wall and the rear wall.

Another important feature of the modules of the present invention is that all of the front connecting walls located between the partition wall and the front wall occupy less than the total area defined between the partition wall and the front wall and between the top and bottom of the front wall. This reduced area is achieved preferably, as shown in FIG. 1, by forming each front connecting wall in the space between the front wall and the partition wall with a top 31 that is below the level of the top of the front wall. This provides a clear space for laying horizontally extending reinforcing bars 32 on the top of the connecting walls between the front walls and partition walls of each row of modules.

The clear space can be provided equally well by forming the bottoms of the front connecting walls in the region between the front wall and partition wall at a level above the level of the bottom of the front wall. Alternatively, the front connecting walls may be formed with openings between their tops and bottoms, but this is less desirable, both with respect to ease of molding and ease of placement of the horizontal reinforcing bars.

As mentioned above, the height dimensions of the front, partition,, and rear walls preferably are equal to each other. Desirably, the tops and bottoms of these walls lie in common planes. The tops and bottoms of the rear connecting walls located between the partition wall and the rear wall may lie in these same planes, although this is not necessary. The modules in successive rows may contact each other only along these flat planes, but it is preferable to provide means for positively locating modules in one row with respect to modules in the next row below or above, so as to facilitate placement of the modules with minimum labor requirements. The locating means may comprise a member extending from a module in one row and engageable with a selected surface of a module in the next row.

In the embodiments illustrated in FIG. 1, locating means are provided in the form of trapezoidal members 33 which extend upward from the tops of the rear connecting walls. These trapezoidal locating members engage mating trapezoidal recesses 34 formed in the bottoms of the rear connecting walls. This locating arrangement is essentially the same as used in the modules in the BROWN et al. U.S. Pat. No. 4,372,091 discussed above. Alternative locating means may be used, if desired Without limitation, such means could include shiplapped or tongue-and-groove top and bottom edges of the front, partition, or rear walls, pins and sockets at the corners of the modules, or other interengaging means for locating one module in one or more predetermined positions on top of another module or modules. The protruding members of such interengaging means could also serve as lifting eyes for the module, or lifting padeyes can be provided separately from the locating means.

The modules of the invention can be cast in conventional molds fabricated of wood or of welded steel plates to create the form of the finished product. Alternatively, a wood pattern can be made first and then a plug mold can be formed by laying up resin impregnated glass fiber mats on the pattern. As mentioned above, the walls of the module may be tapered so that the mold can be removed easily. The face of the front wall of each module is preferably vertical, however, to provide a smooth vertical face for the assembled retaining wall. The mold section for forming this front face should be detachable from the rest of the mold, or at least hinged to one edge of the mold, so that it does not interfere with separating the cast module from the mold. The same is true for the rear and end walls of the mold if the corresponding faces of the module are vertical.

A removable front mold wall also makes it easy to provide a desired texture on the front face of the module by affixing a mat of molded rubber or plastic material to the inside face of the mold. The mat surface can be patterned to simulate natural or cut stone, or it can have any desired geometrical pattern. In this way, the assembled retaining wall can have any desired decorative appearance, such as appearing to be laid up of natural or cut stones.

The procedure for casting a module is conventional. The mold is assembled, and a preformed reinforcing grid is inserted into the mold cavity. The reinforcing grid is formed with vertical corner bars enclosed by stirrups to reinforce the hollow rectangular cells defined by the connecting walls between the front wall and the partition wall and may include looped portions arranged to protrude from the top surface of the finished module to serve as lifting eyes and as locating means, as mentioned above. The mold can be arranged for pouring a module right side up or upside down, depending on which arrangement is more convenient for particular facilities and circumstances.

Right side up pouring allows lifting eyes integrated with the reinforcing grid to extend from the open top of the mold. The mold requires a base that is separable from the wall portions, however, to permit stripping the wall portions from the cured module. Upside down pouring is easier because the walls of the module are thicker at the base. The correspondingly wider openings at the top of the mold for upside down pouring make it easier to pour in the concrete mix and to introduce vibrators for settling the mix. Separating the cured module from an upside down mold involves either lifting the module, base up, from the mold or inverting the entire assembly and then lifting the mold from the module. In all cases, the vertical sides and ends of the mold should be removed first.

The detailed procedures for fabricating and setting up molds, installing the steel reinforcement grid, pouring the concrete, and removing the cured module from the mold are well known and do not require further description or explanation to a person of skill in the art of making prefabricated concrete structural products.

Although the dimensions of the open bin modules of the present invention can be selected by a designer to suit any particular application, the following dimensions for a set of modules are appropriate for most situations. Modules may have an overall length of eight, twelve, or sixteen feet, an overall depth (front-to-rear dimension) of four, six, or eight feet, and a uniform height of two feet The center-to-center spacing of the partition from the front wall, and between the connecting walls, is two feet for all module sizes, with the ends of the front, partition, and rear walls extending beyond the first and second connecting walls by one foot. The thickness of the front and rear walls tapers from four inches at the top to six inches at the bottom. The thickness of the partition wall and the connecting walls tapers from four inches at the top to eight inches at the bottom.

The procedure for erecting a bridge abutment retaining wall by means of these modules will be explained next, in connection with FIGS. 1 and 2. After completion of necessary excavation, the base slab or footing 12 is poured. This footing should be at least a foot thick and extend beyond the retaining wall on all sides. Before the footing is poured, vertical reinforcing bars 36 should be set at spaced intervals equal to the spacing between adjacent connecting walls along the length of the retaining wall. To reduce clutter, only one set of bars 36 is shown in FIG. 1.

The first row of modules **13*d* is placed on the footing slab so that each set of vertical reinforcing bars is disposed in the space between adjacent connecting walls and between the front wall and the partition wall. As each module is being placed, a drain pipe 35 should be laid on the footing immediately behind the module. This is very important to carry away any buildup of water in the fill behind the modules, so that the front-to-rear dimensions of the modules can be calculated on the basis of the retaining wall having to withstand horizontal forces exerted only by the fill material and not also hydrostatic pressure. To avoid water collection inside the modules, an additional drain line 35' may be placed immediately behind the partition wall. If the modules have trapezoidal locating members and recesses 33, 34, the additional drain pipe can fit in the forward recesses 34** in the bottoms of the connecting walls of the first row of modules. If some other type of locating means is used, or none at all, similar recesses can be formed in the bottoms of the connecting walls, or a trench for receiving the drain pipe can be formed in the footing at the time the footing is poured.

The depth (front-to-rear dimension) of the modules in the first row is selected according to the height of the wall and any other consideration affecting the stability of the wall according to standard engineering practice. After the first row of modules is in place, the spaces between the partition walls and the rear walls may be backfilled with gravel or earth 37 in the usual manner. Alternatively, backfilling can wait until after the retaining wall has been erected. In addition, reinforcing bars 32 are laid horizontally across the tops of the connecting walls between the front walls and the partition walls of the modules.

The modules of the next row are then placed on the first row and the backfilling and reinforcement laying steps repeated. This continues until the top row of modules is in place. Because of the relatively small size and weight of the individual modules, they may be placed quickly using equipment generally available to local contractors and with only a few laborers. As shown in FIGS. 1 and 2, the modules in the upper rows do not need to be as deep as in the first row to achieve the necessary stability. Consequently, the rear face of the retaining wall may have a stair step profile.

The abutment is completed by pouring concrete in all the spaces between the front walls and the partition walls to fill these spaces up to the top of the retaining wall, and above to form a cap 38. The result, as shown in the cross-sectional view of FIG. 2, is a solid, monolithic concrete wall that incorporates and integrates the footing with the front walls and the partition walls of all the modules, and with the horizontal reinforcing bars 32 and the vertical reinforcing bars 36.

The previously described vertical bars and enclosing stirrups of the internal reinforcement of the precast modules (not shown in the drawings) also reinforce the columns of concrete poured into the hollow cells of the modules so that the precast and subsequently poured concrete structures work together and strengthen each other.

A bearing pad 39 placed on the cap 38 supports bridge girders 40 in a conventional manner. The pad also supports a poured-in-place concrete apron 41 that is tied into the cap by reinforcing bars 42. The apron provides an isolating transition between a roadway 43, laid on a bed of crushed stone 44 on top of backfilled material behind the rear walls of the modules, and a bridge deck 45.

Figure 2:
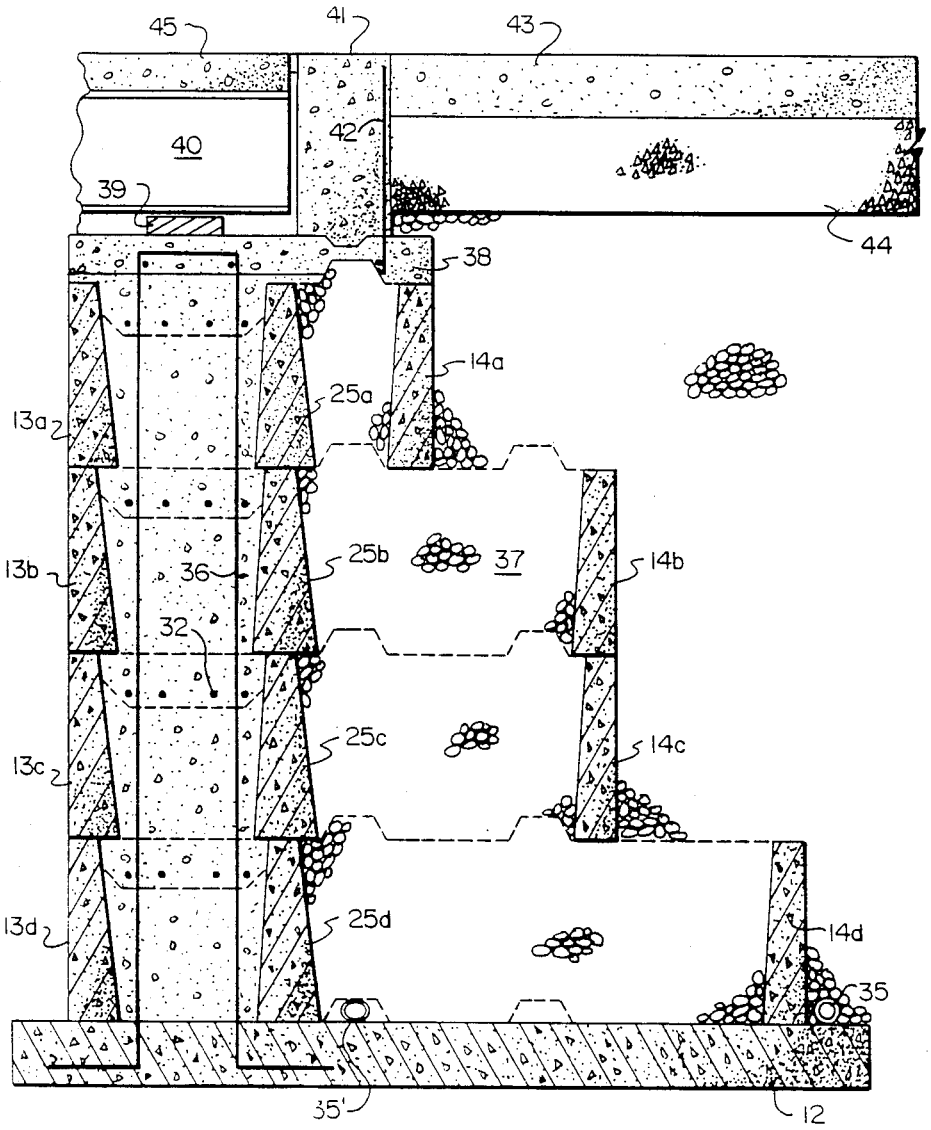
FIG. 2 is an elevation view in cross section of a completed bridge abutment constructed as a stacked assembly of modules as in FIG. 1.

As is clearly apparent from FIG. 2, the monolithic concrete wall of the completed abutment sustains the vertical loads imposed by the bridge and, by being tied into the footing via reinforcing bars 36, is stably supported for resisting the outward pressure of the backfilled material behind the abutment. The drains 35 and 35' behind the modules and at the base of the partition walls relieve pressure due to water which would otherwise accumulate behind the walls. These drains also reduce the possibility of seepage of water between the front walls of the modules. The poured concrete between the front walls and partition walls provides a seal against such seepage under normal circumstances, however.

Figure 3:
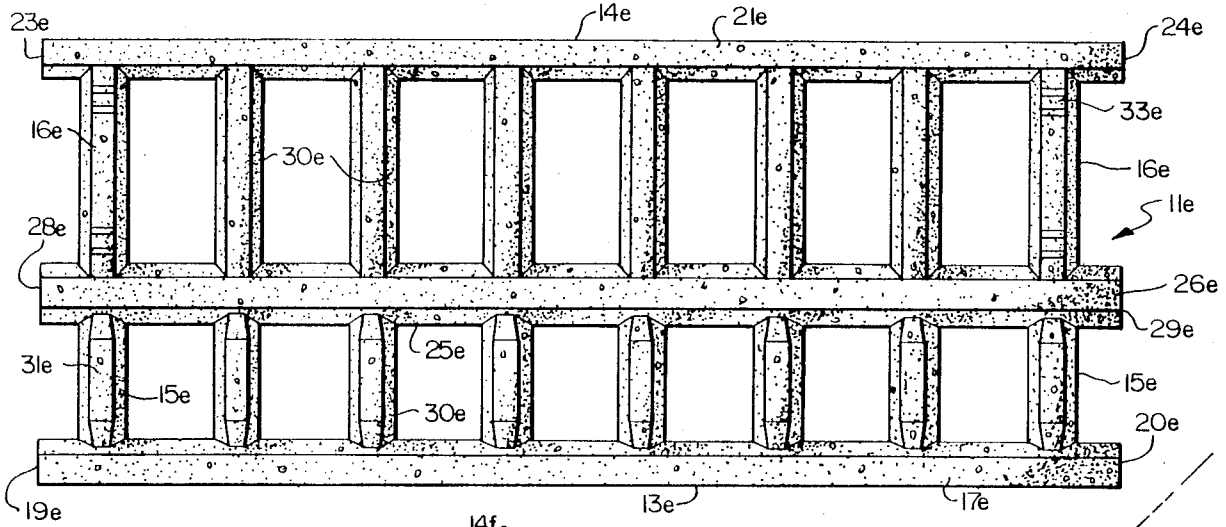
FIG. 3 is a top plan view of an alternative embodiment of one of the modules of FIG. 1.

With reference next to FIG. 3, this plan view shows a module embodiment **11*e* similar to module 11*b* in FIG. 1, except that there is a full complement of intermediate connecting walls 30*e* and there are trapezoidal locating members 33*e* only on the rear portions of the first and second connecting walls 15*e* and 16*e*. The additional locating members of the embodiments in FIG. 1** are not necessary, but the corresponding recesses in the bottoms of all of the rear connecting walls are required so that staggered modules of successive rows can be located relative to any rear connecting wall.

Figure 4:
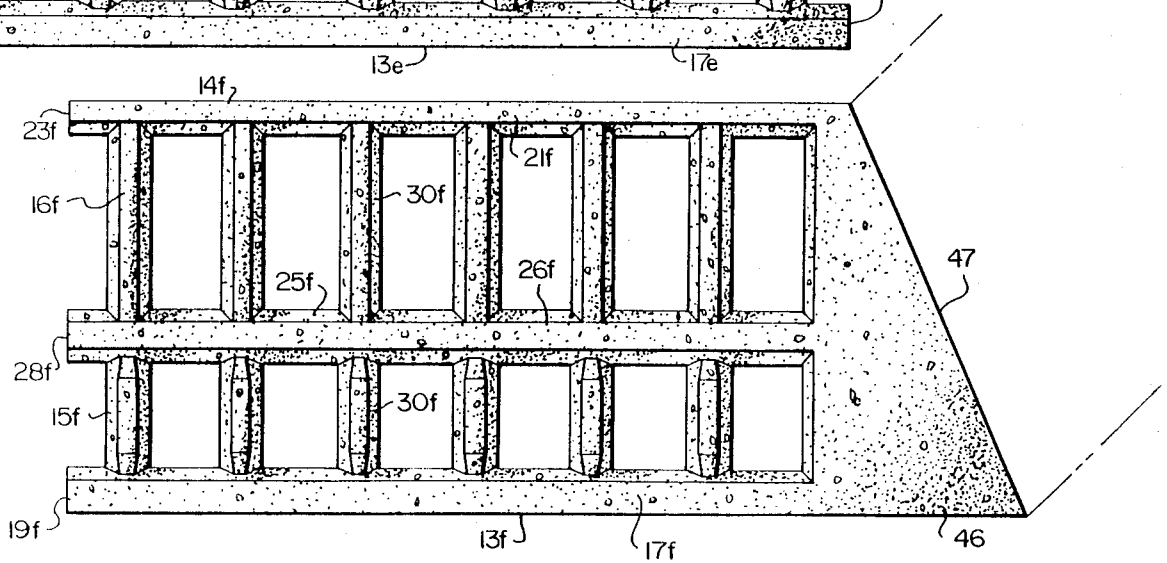
FIG. 4 is a top plan view of another embodiment of a precast concrete module.

FIG. 4 shows an embodiment specially designed with an angled end to mate with a similar module to create wing walls extending at an angle from the abutment wall. In the embodiment of FIG. 4, a module **11*f* has the same elements as the previously described modules, except that it has no locating means and one end terminates in a solid concrete wedge 46*f* having an end face 47*f* lying in a vertical plane that makes an acute angle with the front face of the front wall 13*f*. Alternately, the front, partition and rear walls could be extended to terminate in the vertical plane 47*f***.

The above described features and advantages of the bin-type modules of the present invention and of the resulting sealing load-bearing wall fabricated with these modules represent only the salient elements of the invention. These elements and features can be augmented by others known in the art. For example, the ends of an abutment wall assembly could be finished off with tongued end panels (not shown) that slide into vertical grooves (not shown) near the ends of the front, partition and rear walls in the same manner as in the BROWN et al. '091 patent. Other possible variants include the use of non-integral partition walls similar to partition walls shown by BROWN et al. but extending for the full height of an assembled retaining wall structure.

Figure 5:
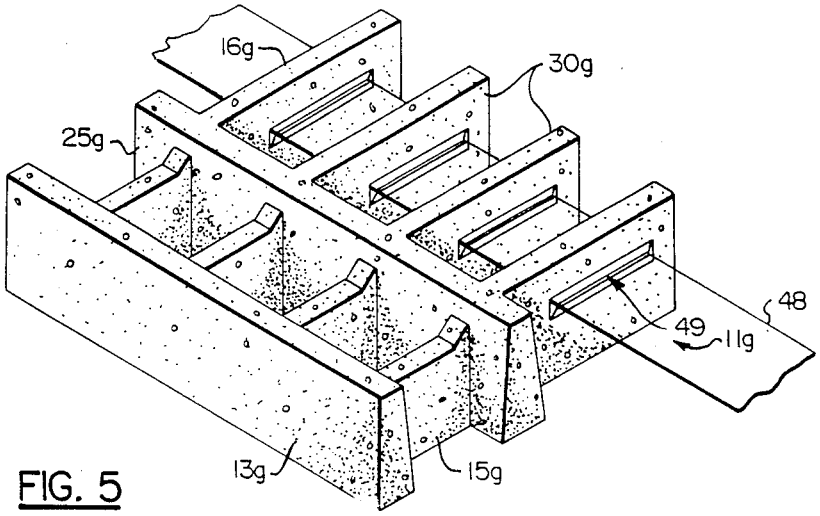
FIG. 5 is a perspective view of still another embodiment of a precast concrete module.
Figure 6:
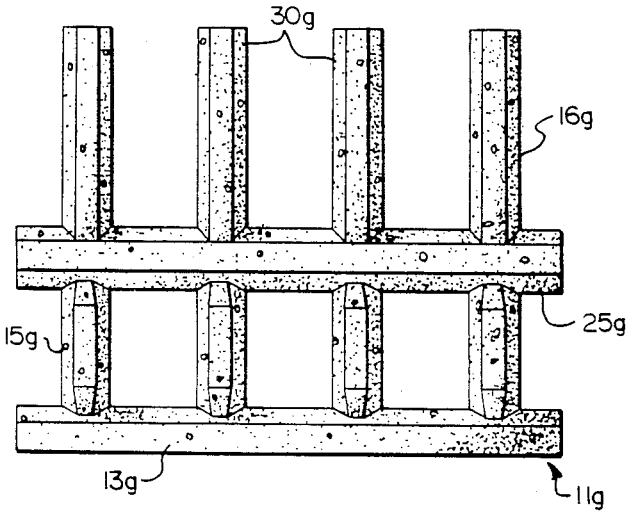
FIG. 6 is a top plan view of the module of FIG. 5.

Furthermore, it is not essential for the stabilizing means of the modules to be a rear wall. In the embodiment of FIGS. 5 and 6, the connecting walls **15*g*, 16*g*, 30*g* terminate in free ends a substantial distance behind the partition wall. Resistance to overturning moments comparable to that developed by the eliminated rear wall can be developed by locating reinforcing sheets 48 horizontally between the rear connecting walls extending behind the partition wall 25*g*. Each sheet 48 can be in the form of an imperforate sheet, or it can be in the form of an open mesh. The imperforate or open mesh sheet is slipped into slots 49** that are formed in the rear connecting walls when the modules are cast and can be fastened to the connecting walls by any suitable means.

Possible examples of such reinforcing sheets include steel or high-tensile strength polymer sheets and woven fabrics of high-tensile strength wires or fibers. Steel sheets should be galvanized or plastic coated to prevent corrosion. Polymer sheets may be solid or may be perforated in a grid pattern such as the high-strength polymer grids sold by the Tensar Corporation of Seattle, Washington.

The sheet type of stabilizing means has several advantages over the integral rear wall stabilizing means. The molds are smaller and less complicated. The modules are smaller and lighter for the same retaining effectiveness, and the unenclosed rear ends of the connecting walls permit easy access for workmen when setting the modules in place and tamping earth backfill.

Another advantage permitted by the use of sheet-type stabilizing means is that the rear connecting walls that are located on the rear side of the partition wall of each module can be hingedly connected to the partition wall instead of being rigid extensions of the front connecting walls.

Figure 7:
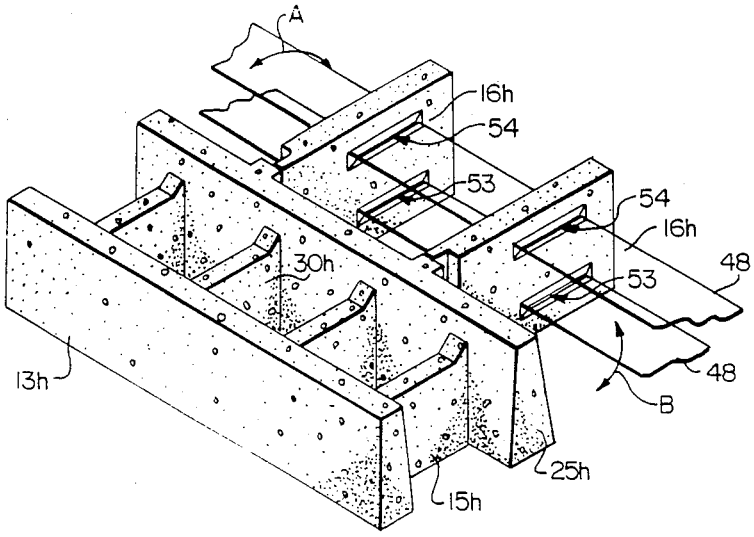
FIG. 7 is a perspective view of yet another embodiment of a precast concrete module having hinged rear connecting walls.
Figure 8:
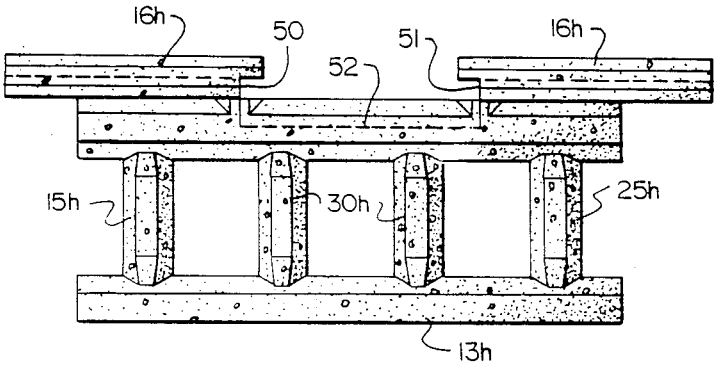
FIG. 8 is a top plan view of the embodiment of FIG. 7, with the rear connecting walls folded against the partition wall.

FIGS. 7 and 8 show an alternative embodiment similar to that of FIGS. 5 and 6, but in which the four rigid connecting walls **15*h* 30*h* between the front wall 13*h* and the partition wall 25*h* are reduced to two hinged connecting walls 16*h* behind the partition wall. The hinges 50, 51 preferably consist of steel mesh or high-strength polymer grid 52 that is embedded as reinforcement in both the partition wall 25*h* and the two rear connecting walls 16*h*. As shown in FIG. 8, the hinged rear connecting walls can lie against the rear face of the partition for compact storage and transport. At the erection site, these rear connecting walls 16*h* are easily swung, as shown by arrows A and B, to extend rearwardly from the partition wall 25*h*. In the extended position, stabilizing sheets 48 are threaded through lower and upper horizontal slots 53, 54 in the same manner as in the embodiment of FIGS. 5 and 6**.

The two rear connecting walls **16*h* of FIGS. 7 and 8 preferably attach to the rear face of the partition wall 25*h*** at locations spaced from each end of the partition wall by one quarter of its length. This location provides equal spacing between the rear connecting wall of a row of modules when set side-by-side for a retaining wall. It also assures that the rear connecting walls of successive courses of modules will be aligned above and rest on the rear connecting walls of modules in the lower rows, even when the modules in each course are staggered in brick-wall fashion.

Although the modules have been shown as being particularly adapted for assembly into roadway bridge abutments, the combined load-bearing and sealing characteristics of a retaining wall formed with these modules make them ideally suited for use in water-retaining walls of dams, locks in rivers and canals, reservoirs, and similar structures.

I claim:

1. A precast concrete module for use in constructing sealing retaining walls capable of sustaining large vertical loads, the module comprising:

a front wall having a front face, a rear face, a top, a bottom, and two ends;

a partition wall spaced from the rear face of the front wall, the partition wall having a front face, a rear face, a top, a bottom, and two ends;

first and second spaced apart front connecting walls extending from the rear face of the front wall to the front face of the partition wall;

at least one rear connecting wall connected to and extending from the rear face of the partition wall, each rear connecting wall having a top and a bottom; and stabilizing means spaced from the rear face of the partition wall and extending transversely from the at least one rear connecting wall, wherein the area of each front connecting wall is less than the total area defined between the partition wall and the front wall and between the top and bottom of the front wall such that when at least two modules are arranged in at least one horizontal row, a clear space is provided for horizontal reinforcing bars extending the length of each row of modules between the front wall and the partition wall, and wherein the locations of the top and bottom of each rear connecting wall are such that when two modules are arranged one on top of the other with a rear connecting wall of one module in vertical alignment with a rear connecting wall of the other module, the bottom of the rear connecting wall of the one module rests on the top of the rear connecting wall of the other module.

2. A precast concrete module according to claim 1 wherein the at least one rear connecting wall comprises first and second rear connecting walls, and the stabilizing means comprises a plastic mesh stretched between the first and second rear connecting walls.

3. A precast concrete module according to claim 1 wherein the front connecting walls located between the partition wall and the front wall have upper edges that are spaced below a plane defined by the tops of the partition wall and the front wall.

4. A precast concrete module according to claim 1 further comprising additional front connecting walls extending between the front wall and the partition wall at spaced intervals between the first and second connecting walls, the additional front connecting walls also providing clear space for horizontal reinforcing bars in alignment with the clear space provided by the first and second connecting walls.

5. A precast concrete module according to claim 1 further comprising means for positively locating modules in one of a plurality of superposed rows of modules with respect to modules in a contiguous row.

6. A precast concrete module according to claim 5 wherein the locating means comprises a member extending from a module in the one row, the member being engageable with a preselected surface of a contiguous module in another row when the modules are located in a predetermined relation to each other.

7. A precast concrete module according to claim 1 wherein the at least one rear connecting wall is connected to the rear face of the partition wall by hinge means that permit swinging the at least one rear connecting wall from a first position approximately parallel to the partition wall to a second position approximately perpendicular to the partition wall.

8. A sealing load-bearing retaining wall comprising a plurality of superposed rows of precast concrete modules, each module having a front wall, a partition wall spaced from the front wall, first and second spaced apart front connecting walls extending between the front wall and the partition wall, at least one rear connecting wall extending rearwardly from the partition wall, such that the top and bottom of each rear connecting wall are in vertical alignment with the rear connecting wall of another module, and stabilizing means extending transversely from the at least one rear connecting walls;

vertical reinforcing members extending from the bottom to the top of the rows of modules in the region between the front walls and the partition walls;

horizontal reinforcing members extending the length of at least one row of modules in the region between the front walls and the partition walls of the modules in the row; and poured concrete filling the region between the front walls and the partition walls of the modules to create, in combination with the front walls, partition walls, the front connecting walls therebetween and the vertical and horizontal reinforcing members, a monolithic sealing load-bearing wall for the abutment that also ties all the modules together and seals against leaks through the interfaces between the front walls of contiguous modules.

* * * * *